US005139250A

United States Patent [19]

Zoltner

[11] Patent Number: 5,139,250

[45] Date of Patent: Aug. 18, 1992

[54] OSCILLATING BLADE ENVELOPE ROTATOR

[75] Inventor: John D. Zoltner, Rochester, N.Y.

[73] Assignee: Xerox Corporation, Stamford, Conn.

[21] Appl. No.: 627,519

[22] Filed: Dec. 14, 1990

[51] Int. Cl.[5] ..... B65H 5/00

[52] U.S. Cl. ..... 271/2; 271/9; 271/139; 271/251; 271/267; 271/165; 271/167

[58] Field of Search ..... 271/2, 9, 10, 18, 113, 271/165, 166, 184, 185, 225, 267, 162, 164, 137, 139, 140, 251, 167; 221/273, 274

[56] References Cited

U.S. PATENT DOCUMENTS

| | | | |
|---|---|---|---|
| 1,143,269 | 6/1915 | Hess | 271/2 |
| 1,151,792 | 8/1915 | Jaeger | 271/2 X |
| 1,724,199 | 8/1929 | Hoag . | |
| 2,267,574 | 12/1941 | Post | 271/2 |
| 2,521,237 | 9/1950 | Marvin | 101/232 |
| 3,910,007 | 10/1975 | Dorer | 53/58 |
| 4,362,100 | 12/1982 | Wu et al. | 271/2 X |
| 4,371,157 | 2/1983 | Hunt et al. | 271/113 X |
| 4,715,164 | 12/1987 | Luperti et al. | 53/381 R |
| 4,846,455 | 7/1989 | Hurst | 271/2 |
| 4,884,793 | 12/1989 | Hurst | 271/2 |

*Primary Examiner*—Robert P. Olszewski
*Assistant Examiner*—Boris Milef
*Attorney, Agent, or Firm*—William A. Henry, II

[57] ABSTRACT

A gravity fed, "load-while-run" envelope feeder places a high capacity envelope storage bin's long dimension against a printer which creates a small footprint. The feeder transfers the envelopes from the storage bin to a horizontal transporation area with the rotation of a motor driven blade to within access of the printer's feed rollers. The blade catches an envelope's flap to feed it and rotates it by 90° into the transportation area.

14 Claims, 3 Drawing Sheets

OSCILLATING BLADE ENVELOPE ROTATOR

This invention is directed to a continuous envelope feeder, and more particularly, to a continuous envelope feeder adapted for use with printers, or the like, for placing printed matter, e.g. addresses onto envelopes for further processing.

It has long been a desire unrealized to stack envelopes in a long edge (portrait) position within a magazine or bin for feeding to printer and be assured of feeding the envelopes individually. This desire has heretofore been thwarted because the friction that occurs between a stack of envelopes within a magazine is effected by pressure, temperature, humidity and coarseness of the envelopes. Any one of these parameters can cause a multi-feed.

Attempts at overcoming the above-mentioned problems include U.S. Pat. No. 2,267,574 which discloses an envelope feeding mechanism that has a finger which is adapted to engage the flap of the lowest envelope in a feeding magazine to unfold the flap and move it between feed rollers which feed the envelope to a feed table. A means for successively feeding stacked envelopes to a printing press is disclosed in U.S. Pat. No. 1,724,199 that includes successive means active on the flap of the lowermost envelope for separating the same and pushing the envelope forward through a recess in a bed plate which holds the envelopes. An envelope feeding press is shown in U.S. Pat. No. 2,521,237 that includes two rollers, a grasping means mounted on one roller for grasping envelopes within flap corners, means for releasing the envelopes including stationary finger members located between the flap and the body of an envelope, pivoted finger members located between the flap and envelope body, and two rods positioned parallel to the axis of one of the rollers. U.S. Pat. No. 4,884,793 discloses an apparatus for stripping a single envelope from a stack of envelopes. The apparatus includes a picker blade which is articulated by a drive to impart a plurality of motions to the leading edge of an envelope to be separated from the stack. A high speed envelope feeding apparatus is disclosed in U.S. Pat. No. 4,846,455 in which the flap of a closed envelope is opened by raising a cam surface under the flap to position the flap between a fixed pinch roll and a movable pinch roll. The movable roll grasps the flap and extracts the envelope from the feeder to a transport device. Envelope flap opening members which are moved from an inoperative position to a flap opening position by the leading edge of an envelope are shown in U.S. Pat. Nos. 3,910,007 and 4,715,164. In the '007 patent, the leading edge of an envelope is detected by a microswitch which activates the flap opening member. The leading edge of an envelope actually moves a flap opening member.

The above-mentioned envelope feeders are not easily adaptable to current printers and, therefore, do not answer the need for an accessory that feeds envelopes singularly to a printer, or the like, and is compact and low-cost.

Accordingly, a small, compact and low-cost envelope feeder is disclosed for a printer, or the like, which gravity feeds envelopes, flap down, from a high capacity bin to a horizontal transportation area by oscillating a motor driven sheet metal blade 90° which engages between the body of the envelope and the flap and rotates the envelope 90°. The bin includes a clearance slot and an elastomer drag pad to allow only one envelope at a time to pass from the bin to the transportation area.

The above-mentioned features and others of the invention, together with the manner of obtaining them, will best be understood by making reference to the following specification in conjunction with the accompanying drawings, wherein.

Figure 1:
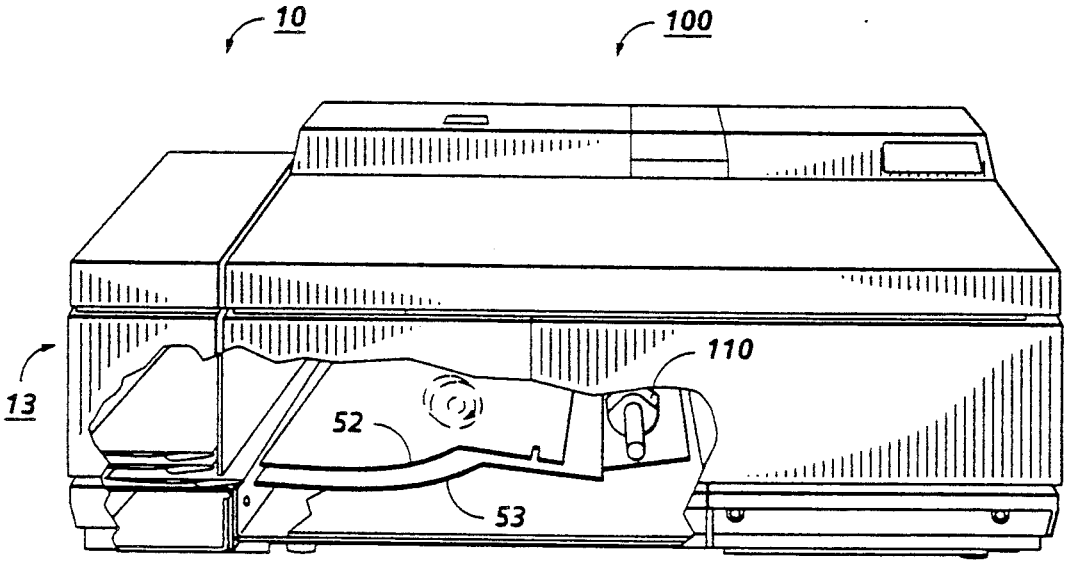
FIG. 1 is a perspective front view of the envelope feeder of the present invention attached to a printer with part of the envelope feeder, as well as, the printer cut away for clarity.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

For a general understanding of the features of the present invention, reference is had to the drawings. In the drawings, like reference numerals have been used throughout to designate identical elements.

As an accessory, an envelope feeder is used only part of the time an imaging apparatus, such as a printer, is in use. As such, it must be compact and unobtrusive from an appearance standpoint, and since it is not a dedicated part of the imaging apparatus, it must be inexpensive. Such an envelope feeder is shown in FIG. 1 as 10 connected to an exemplary printer 100, such as the Xerox 4045®. Envelope feeder 10 is a high capacity (200 envelopes), gravity-fed, load-while-run (when a cover safety interlock is not used) apparatus which is adapted to be connected to a printer with the long dimension of the envelopes placed against the printer for minimum footprint usage. The envelopes are inserted flap down within walls 14 of bin 13. A planar bottom and envelope supporting portion 15 of the bin has a relieved portion 16 therein in the shape of an envelope flap that permits the flap of the lowermost envelope to extend thereinto. A cut-out area in the shape of an envelope flap could be used instead of a relieved area in the bottom surface 15 of the bin 13, if desired. A motor and brackets 11 support a picker blade 20 by way of shaft 12 for back and forth or oscillatory movement within a predetermined space along the bottom surface 15 of bin 13. On demand, blade 20, which is preferably made of sheet metal, but could be made of plastic or similar material, is rotated by motor 11 from a first or home position underlying bin 13 to a second position within printer 100 and adjacent the rear wall 51 of transport cassette 50 and subsequently returned to its home position. A force limiter can be applied to the blade for safety purposes.

Figure 2A:
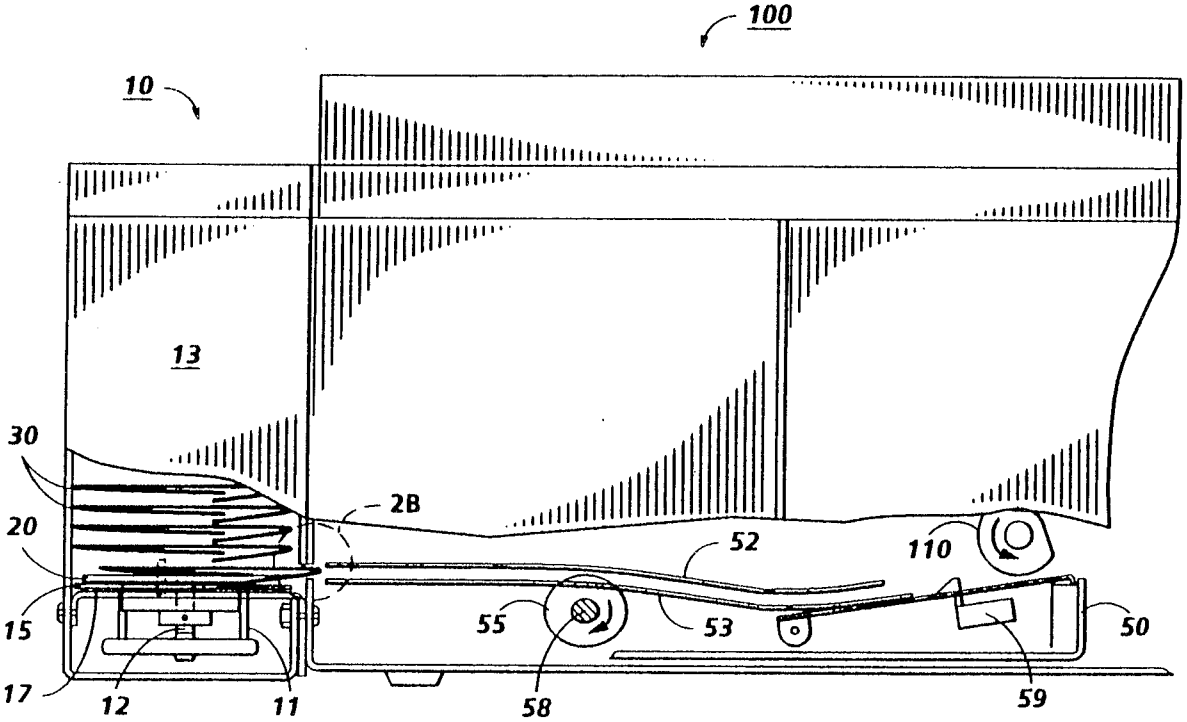
FIG. 2A is an enlarged, partial, schematic front view of the envelope feeder of the present invention.
Figure 2B:
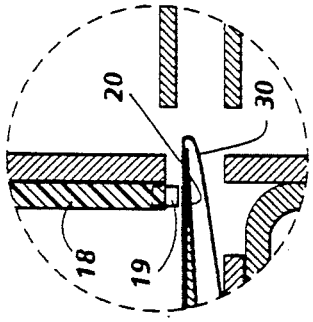
FIG. 2B is a magnified partial front view of the drag pad employed in the envelope feeder of FIG. 2A.
Figure 3:
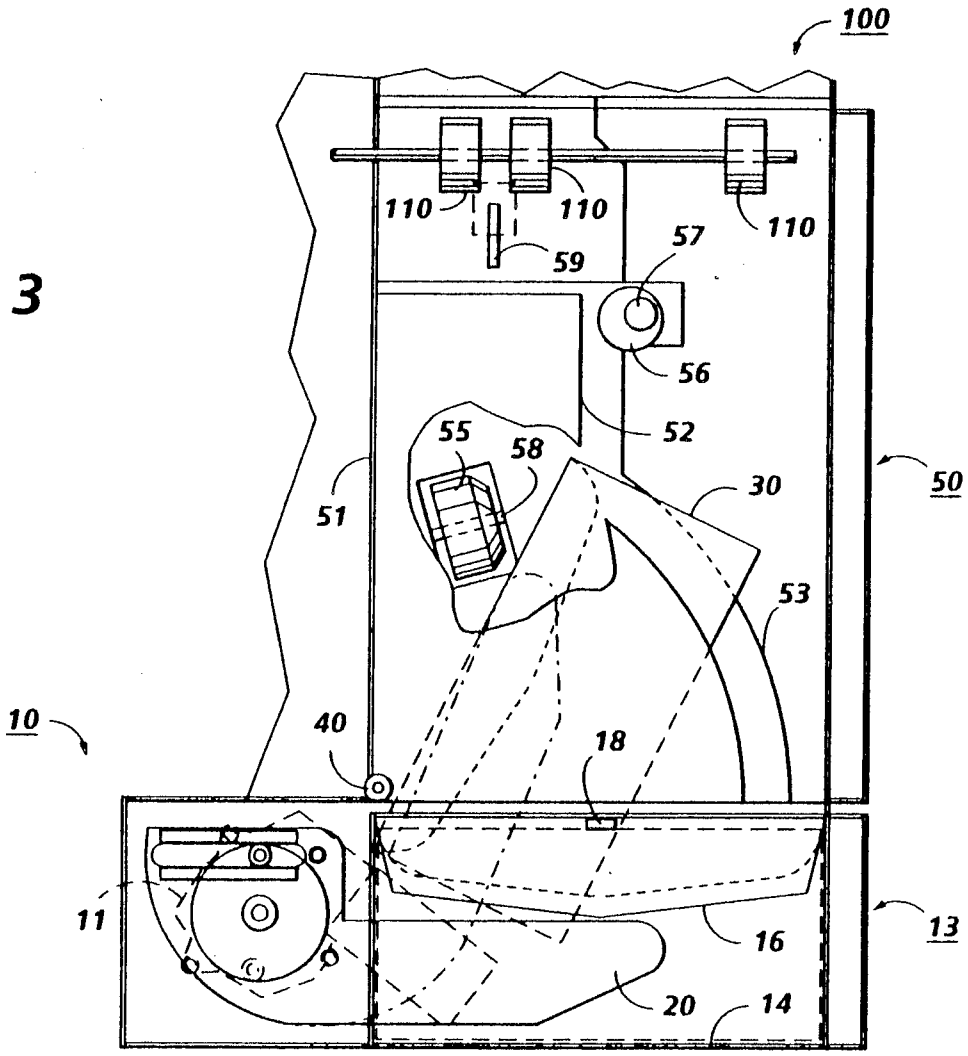
FIG. 3 is a partial, schematic plan view of the envelope feeder of FIG. 1 showing rotation of a picker blade.

Envelope bin 13 has a multi-feed elastomer drag pad or friction surface 19 as a portion of envelope aligning member 18 which is positioned on the wall 14 thereof that is adjacent the left end of the printer, as shown in FIGS. 2A and 2B. The drag pad 19 is at the bottom inside the wall of the bin that is adjacent to the printer and adapted for contact with envelopes moved out of the bin by picker blade 20. Drag pad 19 is attached to the bottom of alignment member 18 that is positioned such that contact of picker member 20 with the crease between an envelope body and flap is immediately adjacent to the drag pad so that continued rotation of the picker member will cause the bottommost envelope in the stack to abrade against the drag pad during feeding while simultaneously preventing the adjacent envelope from feeding also. Picker blade 20 sweeps each envelope sideways and pivots them against a corner peg 40. In order to ensure that envelopes 30 are engaged with drive rollers 110 of the printer, a removable slide-in cassette 50 is used which includes guides 52 and 53 (Mylar or sheet metal) to direct envelopes from bin 13 to a transportation zone and an angled foam scuffer roller 55, as shown in FIG. 3, positioned to accept, side register the envelopes against wall 51 and feed #10 envelopes to the printer's feed rollers 110. Foam scuffer roller 55 is cantileverly mounted on shaft 58 and loaded upward on the remote end of the shaft by a spring (not shown). Scuffer roll 55 feeds the envelopes past a conventional switch 59 which in turn shuts off the scuffer roll motor. There is no communication electrically between the envelope feeder and the printer. High capacity feeder 10 uses its own modular 115 V AC to 28 V transformer for power. After envelope feed has been completed, transport cassette 50 is removed from printer 100 and replaced with a standard or conventional cassette for normal use of the printer. An adjustable eccentric 56 is used for banking envelopes against registration edge 51 and is tightened or loosened for envelope width with knob 57.

In operation, with a full capacity of envelopes stacked in the envelope bin (envelope sizes optionally can be accommodated through the use of two operator adjustable slides inside the bin) (not shown), and an optional "head-effect" weight on top of the stack to optimize loading normal force, the steel blade is rotated 90° in order to place an envelope against registration edge 51 of cassette 50 or until an optional sensor (not shown) is actuated. With the rotated end of the envelope (flap down) slid into the grip of a soft urethane or foam roller 55, the blade is then reversed 90 degrees. This permits the rotated envelope to be easily transported by the foam roller to the printer feed D-rollers 110. The urethane or foam roller has a shaft 58 that is firmly attached to a small motor (not shown) with the shaft being slanted 5°-10° so that the envelope is aligned with the registration edge of the cassette transport and consistent with the printer's paper path. The next envelope's flap then hangs down into the provided clearance for the next feed. The slidable envelope feed enables passive sheet separation.

It should now be apparent that an ultra compact, low cost and non-complex, gravity fed envelope feeder capable of "load-while-run" has been disclosed which places a high capacity, approximately 200 sheet, storage bin long edge dimension adjacent an end of a printer which presents an esthetically pleasing and minimal footprint. An oscillating picker blade transfers an envelope from the envelope storage bin to a horizontal transportation area with just a 90° oscillation of the motor driven blade (the blade slips between the body of the envelope and its flap). After the envelope is rotated, it ends up only six inches from the printer's feed rollers. The bottom envelope is oriented flap down and supported so that there is clearance for the flap to hang open for the blade to enter between the flap and its creased edge. Once the blade slips inside the envelope flap, additional rotation about a pivot point slides the bottom envelope into the printer, now rotated from long edge feed to short edge feed. An operator insertible cassette is used to provide guide baffles and a scuffing drive roller to channel the envelopes from the envelope bin to drive rollers of the printer.

Having thus described the invention, it is obvious that various immaterial modifications may be made in the same without departing from the spirit of the invention: hence, it is intended to be understood as limiting the invention to the exact form, construction, arrangement and combination of parts herein shown and described or uses mentioned.

What is claimed is:

1. An envelope feeder apparatus, comprising:

a bin for supporting a plurality of envelopes, said bin including a bottom member thereof positioned in a horizontal plane with respect to an envelope feeding direction with a recessed area therein, and wherein said bottom member is adapted to support the envelopes in a flat coplanar configuration, flap down with the flap of the bottommost envelope positioned within and extending into said recessed area, and wherein said bin has an output opening immediately above said bottom member, said output opening being configured to permit only single envelopes to pass therethrough; and a picker blade positioned in a horizontal plane adjacent to and beneath said bottom member of said bin; and means for oscillating said blade from a first position beneath said bottom member of said bin into engagement with the crease between the body of the bottommost envelope in said bin and the flap of the envelope and rotating the envelope within the horizontal plane while being oscillated to a second position by said means for oscillating.

2. The apparatus of claim 1, wherein said recessed area is configured in the shape of an envelope flap.

3. The apparatus of claim 2, wherein said bin includes an envelope positioning member attached to a wall thereof.

4. The apparatus of claim 3, wherein said envelope positioning member includes a frictioned surface adjacent the point at which said picker blade contacts the crease between the body of the bottommost envelope in said bin and the flap of the envelope.

5. The apparatus of claim 2, including a removable cassette, said removable cassette having a transport portion that includes a baffle means for guiding envelopes removed from said bin by said picker blade to a predetermined position and a scuffer roller for side registering the envelopes against a registration member.

6. The apparatus of claim 5, wherein said cassette includes pivot means for ensuring predetermined location of envelopes during oscillation of said picker blade.

7. The apparatus of claim 6, wherein said cassette includes sensor downstream of said scuffer roller and adapted to be actuated by envelopes transported by said scuffer roller.

8. The apparatus of claim 2, wherein said picker blade is adapted to change feed orientation of the envelopes from long edge feed to short edge feed.

9. An arrangement for printing image information onto envelopes, comprising:

a printer having at least an end portion;

an envelope feeder apparatus; and wherein said envelope feeder apparatus includes bin means for storing envelopes therein, said bin means having at least one long edge and at least one short edge, and wherein said at least one long edge of said bin means is oriented against said at least one end portion of said printer for minimum footprint usage;

a removable cassette including a transport portion for guiding envelopes from said envelope feeder to an imaging portion of said printer for further processing;

picker means for removing individual envelopes from said bin means and positioning them within said cassette transport portion, and wherein said picker means is adapted to move envelopes within said bin means from a long edge feed position to a short edge feed position.

10. The arrangement of claim 9, wherein said bin means includes an envelope support surface, said envelope support surface includes a recessed area configured in the shape of an envelope flap in order for the flap of the bottommost envelope to rest therein.

11. The arrangement of claim 10, wherein said bin means includes envelope positioning means attached to a wall thereof for aligning envelopes within said bin means.

12. The arrangement of claim 11, wherein said envelope positioning means includes a frictioned surface adapted to prevent multifeeding of envelopes from said bin means.

13. An envelope feeder apparatus, comprising:

a bin for supporting a plurality of envelopes, said bin including a bottom member thereof with a recessed area therein, and wherein said bottom member is adapted to support the envelopes with a major portion of the bottommost envelope being positioned in a horizontal plane against said bottom member, flap down with the flap of the bottommost envelope positioned within and extending into said recessed area, and wherein said bin has an output opening immediately above said bottom member, said output opening being configured to permit only single envelopes to pass therethrough; and a picker blade positioned adjacent to said bottom member of said bin; and means for oscillating said picker blade in a horizontal plane from a first position into engagement with the crease between the body of the bottommost envelope in said bin and the flap of the envelope in order to rotate the envelope within the horizontal plane while oscillating said picker blade to a second position.

14. The apparatus of claim 13, including corner peg means for controlling the pivoting of the envelopes by said picker blade.

* * * * *